US009088103B2

(12) United States Patent
Johnson et al.

(10) Patent No.: US 9,088,103 B2
(45) Date of Patent: Jul. 21, 2015

(54) LATCH FOR CIRCULAR CONNECTOR

(71) Applicant: Omnetics Connector Corporation, Minneapolis, MN (US)

(72) Inventors: Jonas M. Johnson, Isanti, MN (US); Andrew H. Strange, Arden Hills, MN (US); David N. Bender, White Bear Township, MN (US)

(73) Assignee: OMNETICS CONNECTOR CORPORATION, Minneapolis, MN (US)

( * ) Notice: Subject to any disclaimer, the term of this patent is extended or adjusted under 35 U.S.C. 154(b) by 173 days.

(21) Appl. No.: 13/854,905

(22) Filed: Apr. 1, 2013

(65) Prior Publication Data

US 2014/0295692 A1 Oct. 2, 2014

(51) Int. Cl.
*H01R 13/62* (2006.01)
*H01R 13/639* (2006.01)

(52) U.S. Cl.
CPC ..... *H01R 13/6392* (2013.01)

(58) Field of Classification Search
CPC ..... H01R 13/6392; H01R 13/6395
USPC ..... 439/369, 367, 368, 371; 174/84 R
See application file for complete search history.

(56) References Cited

U.S. PATENT DOCUMENTS

| | | | | |
|---|---|---|---|---|
| 3,030,601 | A * | 4/1962 | Krebs | 439/369 |
| 4,875,874 | A * | 10/1989 | Windsor, Jr. | 439/369 |
| 5,135,409 | A * | 8/1992 | Thompson | 439/367 |
| 6,383,003 | B1 * | 5/2002 | Corona | 439/278 |
| 7,186,130 | B1 * | 3/2007 | Miller | 439/369 |
| 8,337,236 | B2 * | 12/2012 | Shu | 439/369 |
| 8,382,507 | B2 * | 2/2013 | Yamaguchi et al. | 439/369 |
| 8,758,034 | B1 * | 6/2014 | Shotey et al. | 439/140 |

OTHER PUBLICATIONS

Omnetics Connector Corporation, Micro Latching Plastic Circular Connectors, Marketing Flyer, as of Feb. 19, 2013, p. 1 of 3, website: www.omnetics.com/products/circular-micro_latches/.

* cited by examiner

*Primary Examiner* — Phuongchi T Nguyen
(74) *Attorney, Agent, or Firm* — Steven R. Yoder, Esq.

(57) ABSTRACT

Apparatus and system for securing a mated connector pair with a latch. The latch is a unitary elongate body configured to receive the mated connector pair. The latch may include a spring member and an internal passageway configured to receive a miniature circular connector. The latch may include a wire retainer feature to secure the latch to a wire harness.

17 Claims, 3 Drawing Sheets

LATCH FOR CIRCULAR CONNECTOR

FIELD OF THE INVENTION

The present invention relates generally to the field of circular connectors. More particularly, this invention supplements the retention force of a mated circular connector pair.

BACKGROUND OF THE INVENTION

The term circular connector applies to any electrical connector possessing multi-pin interconnects with a cylindrical contact housings and circular contact interface geometries. Circular connectors are selected for ease of engagement and disengagement, their ability to conveniently house different types of contacts, their wide range of allowable contact voltages and currents, their ease of environmental sealing and their rugged mechanical performance.

Many connectors, including micro-miniature plastic circular connectors, are known to rely on contact mating forces to hold together a mated connector pair, or connector assembly, comprising a plug and a receptacle.

It is known to employ a threaded coupling arrangement to secure two metal circular connector halves. For example, the use of a threaded coupling nut on the plug, and a corresponding set of threads on the receptacle, to mate the pair of components. The coupling nut is usually equipped with flats or knurling for easy assembly. Threaded coupling is not practical for small diameter plastic circular connectors. Factors include: (i) relatively high cost: (ii) low torque resistance of small plastic components; and/or (iii) threaded assembly of small components.

It is known to use a retaining spring pair to supplement the plastic circular connector assembly's resistance to axial separation. In practice, each halve of the retaining spring pair is assembled to a corresponding half of the circular connector pair such that, when the two halves of the connector pair are mated, the retaining spring pair mates together to supplement the retention of the connector assembly.

The thin metal spring clips of the prior art retaining spring pairs protrude from the connector halves in such a way that they are subject to being damaged and/or catching onto other cables before and after assembly of the connector halves.

SUMMARY

The circular latch described herein provides a unitary body for attaching to the mated connector pair. The unitary body is configured to fit around the connector assembly rather than protrude away from the connector assembly. There are no metal spring components subject to damage and/or snags during packaging and in use.

One aspect of the disclosure is an apparatus for securing a mated connector pair including an elongate body having an internal passageway, the passageway passing through the length of the body, the elongate body having a radial slot along the full length of the longitudinal axis and a longitudinal axis defined by the internal passageway, a spring member integral to the elongate body, the spring member having a semi-circular radial cross-section, a pair of internal shoulders having opposed bearing surfaces, the pair of internal shoulders spaced apart by the spring member, a thumb tab extending longitudinally away from one of the pair of internal shoulders, and a wire retainer adjacent one of the pair of the internal shoulders, the wire retainer forming a closed geometry surrounding the internal passageway, the wire retainer having a flexible sleeve configured to pass electrical wires Another aspect of the present invention is a system for securing a mated connector pair including an elongate body having a first end and a second end, the elongate body having an internal passageway, the passageway passing through the length of the body, and a longitudinal axis defined by the internal passageway, a plug having a first electrical contact, the electrical contact being attached to a first electrical wire, and a receptacle having a second electrical contact, the second electrical contact being attached to a second electrical wire, the receptacle being mated with the plug, wherein the plug and receptacle fit within the internal passageway of the elongate body, further wherein the plug and receptacle are polarized so that they mate together in only one way.

DETAILED DESCRIPTION

Circular connectors provide a polarized connection of multi-wire assemblies. Generally a single or dual pin connector pair requires assembly retention support, such as latching housings, due to insufficient mating force of the contacts. Multi-wire connectors employ multiple contacts within a single housing, so the mating forces of the contacts combine to provide adequate retention without the use of latching hardware Of particular concern in this disclosure are the very small circular connectors, such as the micro-miniature and nano-miniature connectors, where the combined contact mating force is oftentimes inadequate to prevent accidental separation of the mated connector halves. This is due, in part, to the individual contact force being very light. It is also due to the large number of wires combining to withstand high pulling forces. The term "mated" is explicitly defined in the DEFINITIONS section of this description.

A circular latch is provided herein to supplement the contact retention force of small circular connectors. The following discussion introduces a typical circular connector pair and the design of a circular latch for the representative circular connector assembly. It will be appreciated by those skilled in the art that the circular latch may generally be applied to any mated plug and receptacle, but more particularly to any circular connector assembly, including micro-miniature and nano-miniature circular connectors.

Figure 1:
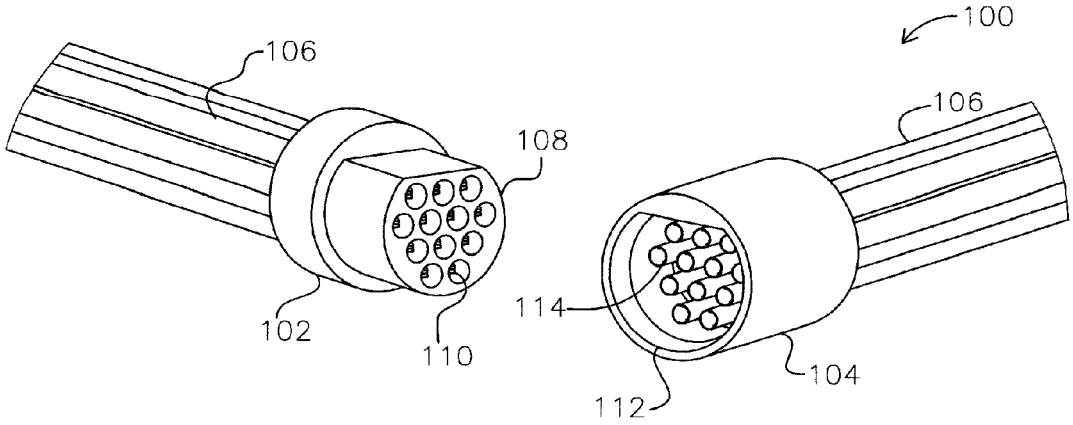
FIG. 1 (Prior Art)
FIG. 1 is a perspective view of an unmated prior art connector pair.

FIG. 1 is a perspective view of an unmated prior art connector pair 100. The connector pair 100 includes a plug 102, a receptacle 104, and electrical wires 106. The plug 102 and receptacle 104 are pre-assembled to electrical wires 106. The connector pair 100 is a wire splice arrangement, that is, each half of the connector pair 100 is assembled to electrical wires. In that way the connector acts to splice the electrical wires together. In one embodiment, the other ends of the electrical wires are assembled to connector halves to form jumper assemblies, or wire harnesses. In other embodiments, the electrical wires are terminated or otherwise prepared for subsequent assembly, such as in the field during installation projects.

The plug 102 includes a plug end 108 and contact pins 110. The plug end 108 includes openings though which the contact pins 110 are accessible. The contact pins 110 are assembled to the electrical wires 106 and are press-fit, or otherwise retained, into the plug end 108.

The receptacle 104 includes a receptacle opening 112 and sockets 114. The receptacle opening 112 surrounds each of the sockets 114. The sockets 114 are assembled to the electrical wires 106 and are press-fit, or otherwise retained, within the receptacle opening 112.

The plug end 108 is configured to fit into the receptacle opening 112. The plug end 108 and receptacle opening 112 are configured to mate together in only one orientation, in other words, the two connectors halves 102, 104 are polarized.

Figure 2:
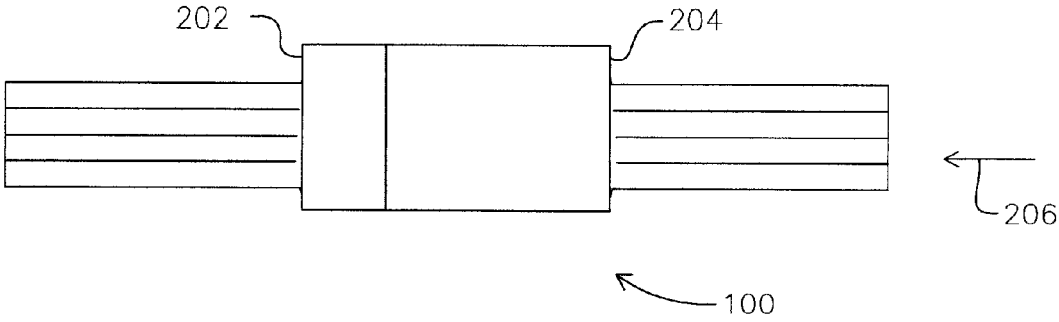
FIG. 2 (Prior Art)
FIG. 2 is a top plan view of a mated prior art connector pair.

FIG. 2 is a top plan view of a mated prior art connector pair 100. When assembled the two connector halves 102, 104 form a single cylindrical unit with electrical wires 106 extending axially away from each end of the mated connector pair. The connector halves 102, 104 are mated by axially directed compressive force. When oriented correctly and upon application of inward axial force 206 to the ends of the two connector halves, the sockets 114 fit into the corresponding plug end openings and over the contact pins 110. The mating force 206, or contact force, required to fit the sockets 114 over the contact pins 110 is roughly equivalent to the separation force required to separate the contact pins 110 from the sockets 114. It is that contact force that the prior art connector assembly 100 relies upon to maintain a secure electrical wire connection.

Figure 5:
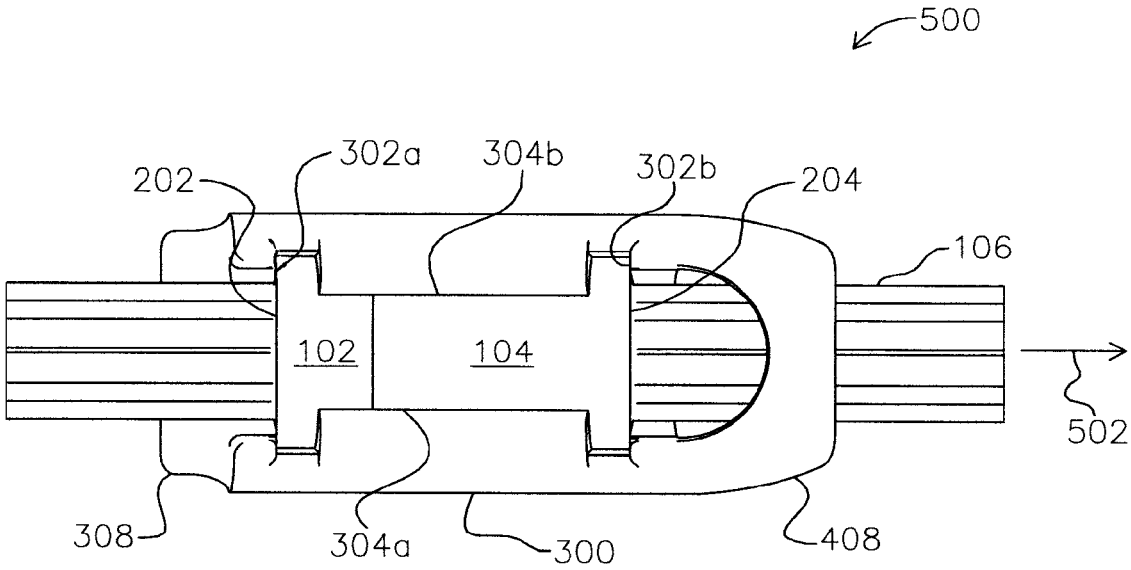
FIG. 5 is a bottom perspective view of the circular latch shown in FIG. 3 assembled to the two mated prior art connector halves of FIG. 2.

The mated connector pair 100 includes two surfaces oriented perpendicular to the direction of the separation force 502 (See FIG. 5). The two surfaces are the plug shoulder 202 and the receptacle shoulder 204. As will be discussed in detail below, the circular latch 300 takes advantage of the configuration of the connector shoulders 202, 204 to resist the separation force 502.

Figure 3:
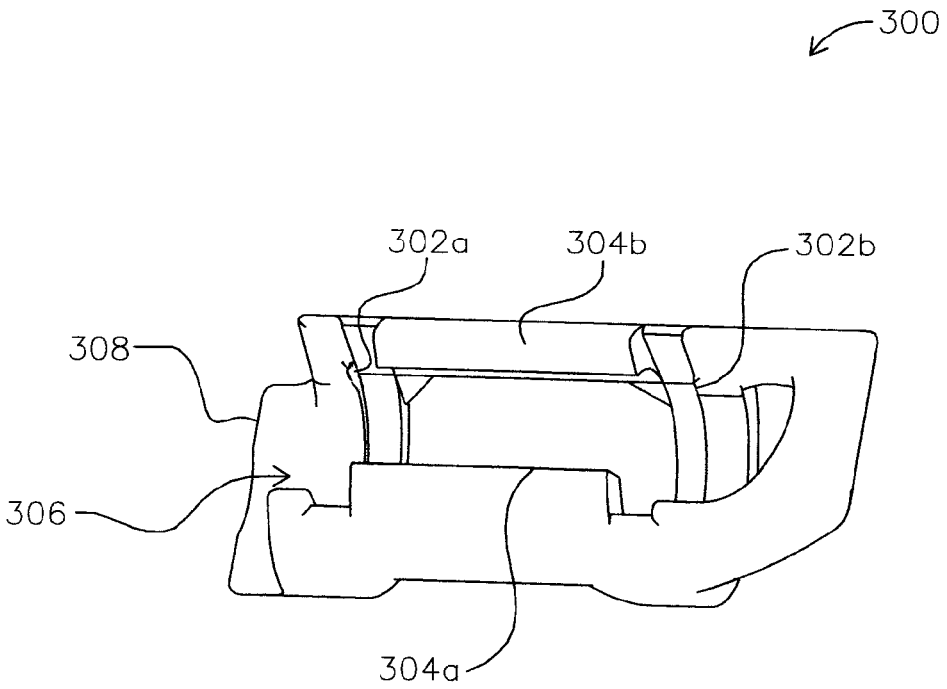
FIG. 3 is a bottom perspective view of a circular latch according to an embodiment of the present invention.

FIG. 3 is a bottom perspective view of a circular latch 300 according to an embodiment of the present invention. Several features of the circular latch 300, as shown, are not required to supplement the standard retention force of prior art connectors. However, these features are provided to present additional benefits likely to be found in a commercial embodiment of the present invention.

Figure 4:
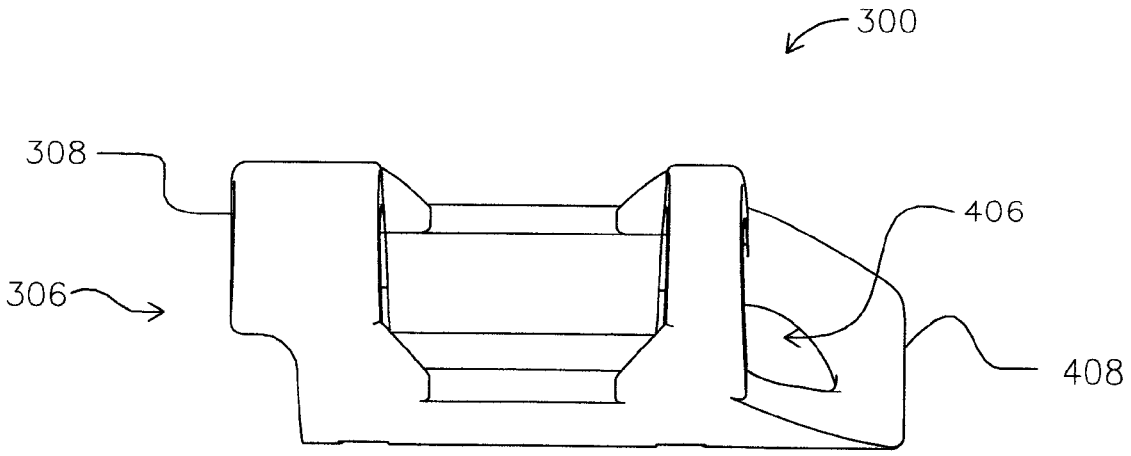
FIG. 4 is a top perspective view of the circular latch shown in FIG. 3.

FIG. 4 is a top perspective view of the circular latch 300 shown in FIG. 3. The discussion that follows will refer to reference numbers in both FIGS. 3 and 4 to describe the circular latch 300. Circular latch 300 is a one-piece body having a generally cylindrical outer shape and a generally cylindrical internal passageway. In the illustrated embodiment, the profile of the circular latch 300, when viewed into the central axis, appears as a thin ring. The views shown of the latch 300 may not appear to represent the described profile. In the illustrated embodiment, the outer shape and inner passageway share a common central axis. In other embodiments, the central axis of the inner passageway is not common to the central axis of the outer shape of the body.

Circular latch 300 includes latch shoulders 302*a*, 302*b*; connector body clips 304*a*, 304*b*; wire passages 306, 406; wire retainer 408; and thumb tab 308. The latch shoulders 302*a*, 302*b* are spaced apart on the circular latch 300 to closely match the distance between the plug and receptacle shoulders 202, 204 on the mated connector assembly 100. In that way, the mated connector assembly 100 fits between the two shoulders 302*a*, 302*b*. Accordingly, the distance between latch shoulders 302*a*, 302*b* will vary with to the dimensions of the mated connector pair for which the circular latch is designed to secure.

Connector body clips 304*a*, 304*b* are designed to flex somewhat during installation. In practice, the latch 300 is pressed onto the mated connector assembly and remains attached to the mated connector assembly. The attachment may allow axial rotation of the latch 300 about the mated connector assembly 100. The flexure of the clips is necessary in the illustrated design because there is no secondary means to attach the connector body clips 304*a*, 304*b* to the connector assembly 100. Where additional spring clips are employed or a means for closing connector body clips around the connector assembly, the flexibility of the clips is not necessary.

Wire passages 306, 406 provide for the pre-wired connector assembly 100 to remain mated and intact during installation of the circular latch 300. Wire passage 306 is not closed, but remains sufficiently open to receive the pre-installed wires and mated connector assembly from one side through a longitudinal slot.

Wire passage 406 is a closed geometry. Wire passage 406 is not required for supplementing the mating force of the mated connector assembly, but is present in some embodiments of the present invention so that: (i) the latch 300 may be secured to a jumper assembly; and (ii) so that it is not lost during shipment and use. In one embodiment, the latch 300 is installed onto a set of wires prior to termination in the field. It should be noted that so long as the latch 300 includes wire passage 406, the latch 300 cannot be installed onto a mated connector pair unless it is installed prior to mating and preferably, prior to terminating an opposite end of the electrical wires 114.

Wire retainer 408 makes up part of the closed geometry associated with the wire passage 406 discussed above. Wire retainer 408 is also an optional feature provided herein as a further example of a feature that may be available in a commercial embodiment of the circular latch 300. Wire retainer 408 is configured such that the bundle of electrical wires 114 may pass through passage 406 at an angle substantially perpendicular to the longitudinal axis of the circular latch 300. Additionally, when installed onto the connector assembly 100, the wire retainer 408 provides a support surface substantially parallel to the longitudinal axis of the electrical wires. The retainer feature may further provide strain relief for the connector assembly 100. In one embodiment (not shown), the wire retainer is a flexible rubber boot that the protruding electrical wires 114 may pass through to provide strain relief from bending and pulling forces. In another embodiment, the wire retainer encircles the electrical wires and is made of a heat shrinkable material, such that with the application of heat, a secure strain relief is created.

Thumb tab 308 extends axially away from the latch shoulder 302*a*. Its shape matches the curvature of the body of the latch 300, but only over a short radial distance. The thumb tab 308 provides a leverage means for prying the circular latch 300 from the mated connector assembly 100. The thumb tab 308 is presented in this disclosure as a feature of convenience. The latch 300 would resist axial separation of the mated connector assembly whether or not the thumb tab 308 is present. However, without the thumb tab, the user may resort to the use of a screwdriver or similar device to pry off the latch 300. Actions taken to remove the latch 300 may damage the wires and/or the attachment of the wires to the plug or receptacle, creating a short condition.

FIG. 5 is a bottom perspective view of the circular latch 300 as shown in FIG. 3 assembled to the mated prior art connector halves 102, 104 as shown in FIG. 2 to form a pull resistant connector assembly 500. In the illustrated embodiment, latch shoulder 302*a* aligns with plug shoulder 202 and latch shoulder 302*b* aligns with receptacle shoulder 204. It should be noted that the assembly is reversible, that is, the latch 300 will fit onto the mated connector pair 100 if flipped 180 degrees from the orientation shown in FIG. 5.

The latch shoulders 302*a*, 302*b* take advantage of the fact that the connector shoulders 202, 204 provide force bearing surfaces oriented perpendicular to the direction of the separation force 502. With the connector shoulders 202, 204 located on the inside of the latch shoulders 302*a*, 302*b*, the mated assembly's resistance to the separation force 502 increases. Experimentation using a prototype latch assembly including a latch having similar features as latch 300 shows that the resistance to the separation force of a 12-pin micro-miniature circular connector pair increases from approximately 3 pounds, without the latch, to 40 pounds with the latch installed. For another reference, the prior art retainer spring assembly tests at only a 9 pound separation force resistance.

As mentioned above, the prior art retainer springs have a tendency to deform and/or snag during use. The circular latch 300 resists hanging up on objects because of its cylindrical outer shape and cylindrical inner passageway. The configuration of the circular latch includes: (i) smooth outer surface; (ii) axially rotatable elongate body about cylindrical connector pair; (iii) low radial profile, or relatively thin walls. These features provide improved resistance to damage during shipment and snagging wires and cables during installation.

FURTHER COMMENTS AND/OR EMBODIMENT(S)

In some embodiments of the present invention, the circular connector latch holds two connectors together, thus preventing them from separating by snapping over the mated pair and catching on the back of each insulator. Unique features of the circular connector latch include: (i) snapping over both connectors, or connector halves; (ii) working in any orientation along the connectors' axis; and (iii) reducing the likelihood of disconnection.

In some embodiments of the present invention, the circular latch is injection molded. The illustrated embodiment of latch 300 is optimized for injection molding in that is may be made by a straight pull without the need of side action.

In some embodiments of the present invention, a loop is provided on one end to thread the wire or cable through. This feature will prevent the separation of the latch from the wired or cabled connector assembly. The loop allows the circular latch to remain captive on a wire harness.

Wire passage 406 is not required for supplementing the mating force of the mated connector assembly, but is present in some embodiments of the present invention so that the latch 300 may be secured to a jumper assembly so that it is not lost during shipment and use.

In some embodiments of the present invention, the latch is designed to secure mated connectors where very little room is available.

In some embodiments of the present invention, the latch shoulders are configured to lock the connector together.

In some embodiments of the present invention, an extended lip provides a finger grip for unlatching the clip, or circular latch.

DEFINITIONS

The following paragraphs provide definitions for certain term(s) used in this document:

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

Embodiment: see definition of "present invention" above—similar cautions apply to the term "embodiment."

And/or: non-exclusive or; for example, A and/or B means that: (i) A is true and B is false; or (ii) A is false and B is true; or (iii) A and B are both true.

Mated (and other forms of the word): assembly of the plug and receptacle halves of a connector pair such that electrical continuity exists between the two halves.

The invention claimed is:

1. An apparatus for securing a mated electrical connector pair, the apparatus comprising:

an resilient elongate body having an internal passageway, the internal passageway passing through the length of the resilient elongate body, and a longitudinal axis defined by the internal passageway;

a securing member formed as a centrally located portion of the resilient elongate body;

a pair of internal shoulders, the securing member located between the pair of internal shoulders; and a thumb tab extending longitudinally away from a first shoulder of the pair of internal shoulders wherein:

the securing member is configured to engage the mated electrical connector pair, covering only a portion of the mated electrical connector pair;

the pair of internal shoulders is spaced apart to each receive a corresponding end portion of the mated electrical connector pair; and the thumb tab has a semi-circular radial cross-section.

2. The apparatus of claim 1, wherein the resilient elongate body includes a radial slot along the full length of the longitudinal axis.

3. The apparatus of claim 1, wherein the resilient elongate body is plastic.

4. The apparatus of claim 1, wherein the pair of internal shoulders have axially inward facing bearing surfaces.

5. The apparatus of claim 1, wherein the securing member covers at least a portion of each connector body of the electrical connector pair.

6. The apparatus of claim 1, further including:

a wire retainer adjacent one of the pair of the internal shoulders, the wire retainer forming a closed geometry surrounding the internal passageway.

7. The apparatus of claim 6, wherein the wire retainer includes a flexible sleeve configured to pass electrical wires.

8. A system for securing a mated connector pair, the system comprising:

a resilient elongate body having a first shoulder and a second shoulder, the resilient elongate body having an internal passageway, the internal passageway passing through the length of the resilient elongate body, and a longitudinal axis defined by the internal passageway;

a plug having a first electrical contact, the first electrical contact being attached to a first electrical wire, the plug having a plug end;

a receptacle having a second electrical contact, the second electrical contact being attached to a second electrical wire, the receptacle having a receptacle end, the receptacle being mated with the plug to form a mated connector pair; and a flexible member extending out from the resilient elongate body;

wherein:

the plug and receptacle has a size and shape to fit within the internal passageway of the resilient elongate body between the first shoulder and the second shoulder, the plug end and the receptacle end adjacent a corresponding one of the first shoulder and the second shoulder; and the flexible member is sized and located to cover only a portion of the mated connector pair.

9. The system of claim 8, further including:

a pair of internal shoulders having axially inward facing bearing surfaces, the pair of internal shoulders spaced apart by the flexible member.

10. The system of claim 8, further including:

a wire retainer adjacent one of the first end and the second end of the resilient elongate body, the wire retainer forming a closed geometry surrounding the internal passageway.

11. The system of claim 8, wherein the resilient elongate body includes a radial slot along the full length of the longitudinal axis.

12. The system of claim 8, wherein the plug and the receptacle are polarized so that they mate together in only one way.

13. The system of claim 8, wherein the flexible member covers at least a portion of the plug and a portion of the receptacle.

14. A method of securing a mated connector pair, the method including the steps of:

mating together a plug having a first electrical contact, the first electrical contact being attached to a first electrical wire, and a receptacle having a second electrical contact, the second electrical contact being attached to a second electrical wire, to form a mated connector pair, the mated connector pair having a plug shoulder at a first end and a receptacle shoulder at a second end, the first and second ends being located at opposite ends of the mated connector pair;

pressing onto the mated connector pair a resilient elongate body having an internal passageway passing through the length of the resilient elongate body and defining a longitudinal axis, the resilient elongate body having a first shoulder and a second shoulder, the first and second shoulders spaced apart such that the plug shoulder and the receptacle shoulder are adjacent a corresponding one of the first and second shoulders, the resilient elongate body further having a securing member located between the first shoulder and the second shoulder, the securing member sized and located to cover only a portion of the resilient elongate body.

wherein:

the mated connector pair fits into the internal passageway of the resilient elongate body; and the securing member retains the mated connector pair within the internal passageway.

15. The method of claim 14, further including the step of:

inserting one of the first electrical wire and the second electrical wire through a wire retainer adjacent one of the first end and the second end of the resilient elongate body, the wire retainer forming a closed geometry surrounding the internal passageway.

16. The method of claim 14, wherein the resilient elongate body further includes:

a radial slot along the full length of the longitudinal axis.

17. The method of claim 14, wherein the securing member covers at least a portion of the plug and a portion of the receptacle.

* * * * *